US005626039A

United States Patent [19]

Solari et al.

[11] Patent Number: 5,626,039

[45] Date of Patent: May 6, 1997

[54] ELECTRONIC SAFETY-LOCK

[76] Inventors: Antonio Solari, Largo Marconi n. 7, I-16040 Leivi; Roberto Mottola, Via Privata Argiroffo n. 1, I-16043 Chiavari, both of Italy

[21] Appl. No.: 629,578

[22] Filed: Apr. 9, 1996

[30] Foreign Application Priority Data

Apr. 12, 1995 [IT] Italy ..... GE95A0036

[51] Int. Cl.[6] ..... E05B 47/00

[52] U.S. Cl. ..... 70/279; 70/280; 70/283; 292/142; 292/144

[58] Field of Search ..... 70/190, 465, DIG. 49, 70/277–283; 292/142, 144

[56] References Cited

U.S. PATENT DOCUMENTS

| | | | |
|---|---|---|---|
| 657,211 | 9/1900 | Carleton | 70/277 |
| 1,378,622 | 5/1921 | Sarbij | 292/142 |
| 3,767,240 | 10/1973 | Belanger | 292/144 |
| 4,438,962 | 3/1984 | Soloviff et al. | 292/144 |

FOREIGN PATENT DOCUMENTS

| | | | |
|---|---|---|---|
| 2490707 | 3/1982 | France | 70/277 |
| 2536108 | 5/1984 | France | 292/144 |
| 8406663 | 8/1985 | Germany . | |
| 3620799 | 2/1987 | Germany . | |
| 9413062 | 2/1995 | Germany . | |
| 148703 | 2/1955 | Sweden | 292/144 |
| WO84/03909 | 10/1984 | WIPO . | |

*Primary Examiner*—Lloyd A. Gall

*Attorney, Agent, or Firm*—Graham & James LLP

[57] ABSTRACT

Electric safety-lock consisting of a motor (3) which by means of movement reduction gears (4, 5) drives a worm screw (6) axially mounted on the driven wheel (5). A slider (8) is keyed onto the worm screw (6) on which the mobile lock studs (9) entering the holes (10) in the locking box (1) are fastened. A mobile rack (13) is mounted on the slider (8); the rack (13) may be operated in case of emergency by a gear wheel (14) meshing with a cylinder or sprocket latch (17) and functioning when using a key (15) or knob. An electric circuit provided with sensors (24, 25, 26) provides for remote control (34) of the door lock via opening (A) and closing push-buttons (C). The safety-lock may also be equipped with an alarm system.

10 Claims, 5 Drawing Sheets

ELECTRONIC SAFETY-LOCK

It is well known that mechanical locks are used for outer doors, main access doors, gates etc., which are usually opened and closed with a key.

These known locks are either simple lever tumbler locks, safety cylinder, Yale or sprocket latch locks, the lever tumbler locks being scarcely used now because they are easy to be tampered with, so that safety cylinder or sprocket latch locks are commonly used.

These safety locks are mechanically operated with keys and may feature a keyhole on both sides or only on the outside while on the inside the door is opened or closed with a handle or knob.

Although it is more difficult to tamper with these cylinder or sprocket latch locks, the slider of the lock and its locking stud may be easily shifted from their closing position when first pulling out the cylinder.

This is the reason why combined lever/cylinder locks have been recently introduced, from which the cylinder cannot be pulled out.

Electronic locks are also commonly known and specifically used for entrance doors and gates which are automatically opened from inside and with a key from outside. These door locks,are for instance adopted for the entrance doors of buildings with housephones.

This invention has the aim to provide a safety-lock essentially designed for electronic actuation and to prevent any kind of tampering and unwanted opening, so that it will be essentially operated by an electromechanical system and may be connected to the general alarm system of the dwelling or more simply to the door lock. This door lock is actuated by a remote control.

In short, the key lock according to this invention is consisting of a usually low voltage motor causing by means of a reduction gear, the rotation of a worm screw fitted with a mobile slider bearing the mobile studs that enter the holes or borings drilled in the latch box mounted on the fixed doorwing or in the wall in front of the lock.

A mobile rack is secured to the slider and is activated by a gear that may engage a cylinder or sprocket latch by means of a key or knob.

The levers or arms used to block the door at floor level or to the doorposts may also be connected to this slider.

It follows that activation of the motor in either direction will cause the studs to move forewards thus closing the lock or backwards to open the door lock without actuating the key locked cylinder, although it causes the rack to move in the required sense.

The cylinder, rack and studs are only key operated in case of failure of the electric system and their emergency operation mode will be described hereinafter.

An electromechanical unit is mounted on the rack which will enable electric operation of the door lock but not its mechanical operation with the key since the latter is only used in emergency cases.

The Electronic control system of the door lock is mounted on a control panel and is involving numerous sensors activated by the rack movements. This control panel permits normal operation as well as emergency operation of the door-lock and its connection to the alarm system. This control panel and its circuitry will be described in detail hereinafter.

The key-lock subject matter of this invention as outlined above may also feature a built-in automatic latch as normally used ill entrance doors and gates so as to make it easier for the user to adopt this locking system.

The invention in question is illustrated in its practical and exemplifying implementation in the enclosed drawings in which.

Figure 1:
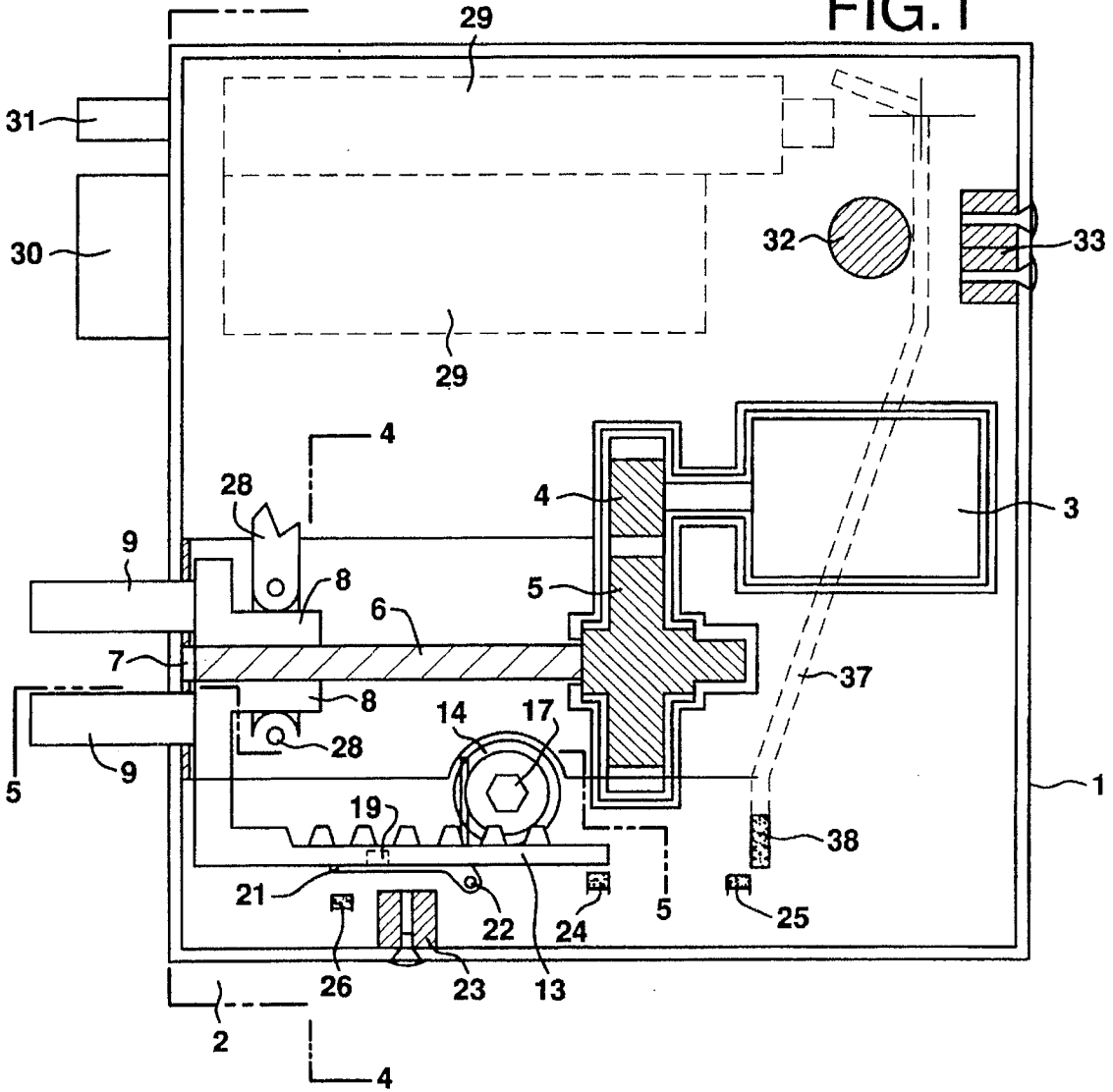
FIG. 1 shows a frontal view of the inside of the safety-lock according to this invention, with drawn-out lock studs.
Figure 2:
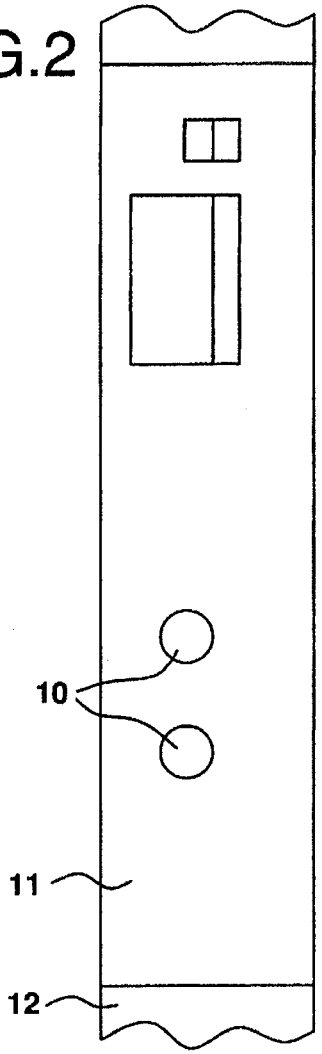
FIG. 2 shows a side view of the fixed lock plate with the holes in which the studs will engage.
Figure 3:
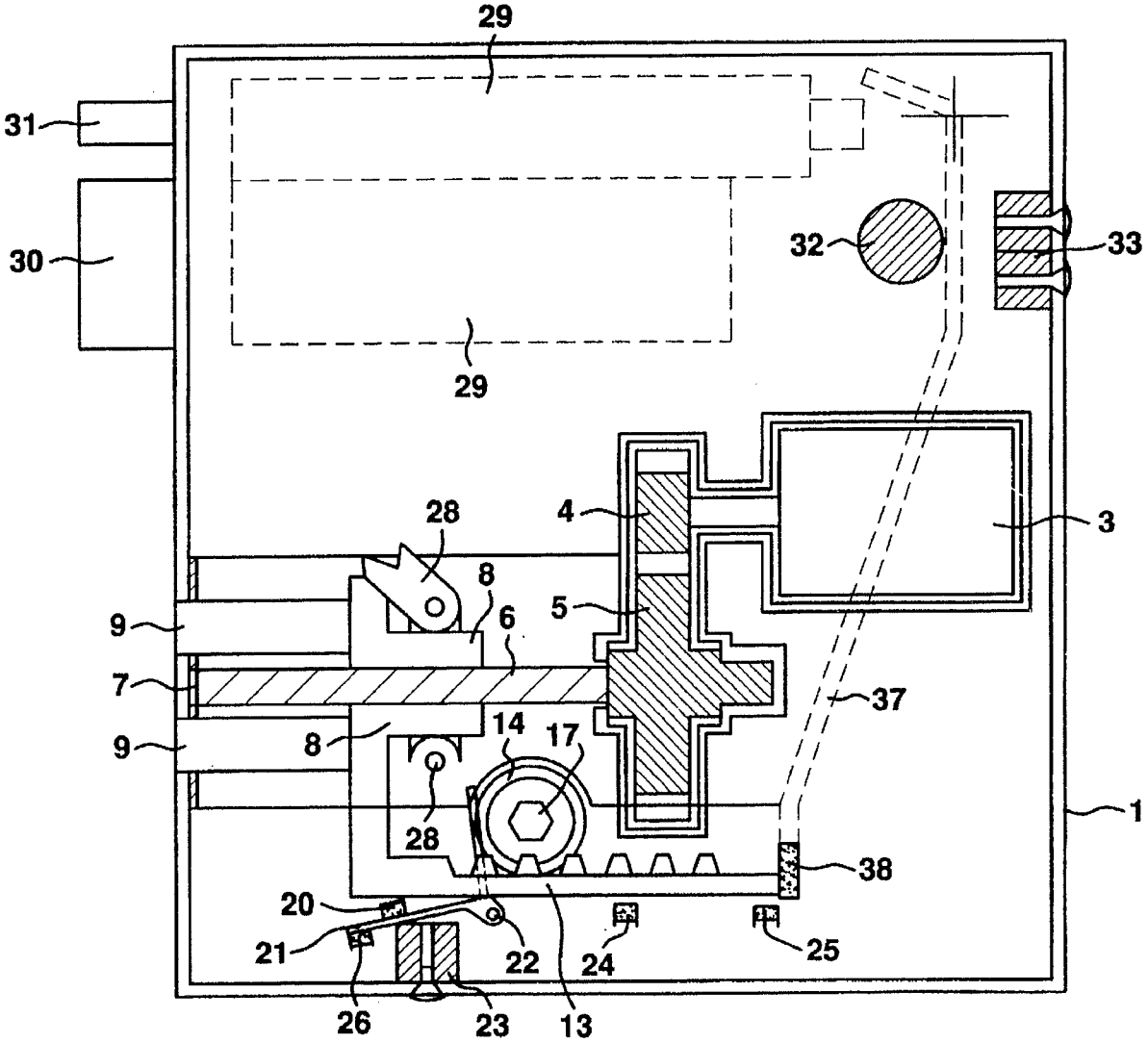
FIG. 3 shows a front view of the safety lock illustrated in FIG. 1 with retracted lock studs.
Figure 4:
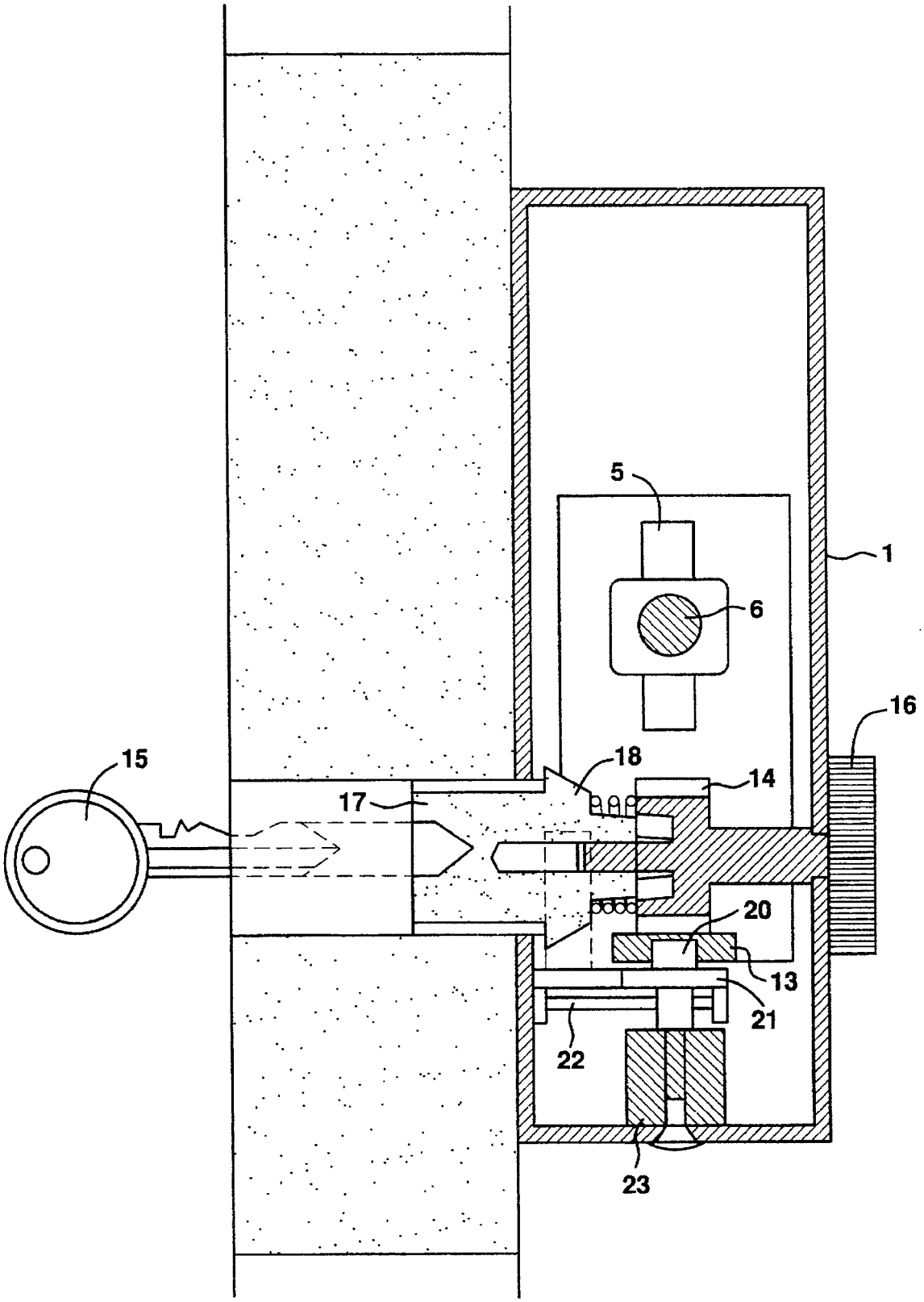
FIG. 4 shows the safety lock section according to the 4—4 axis of FIG. 1.

With reference to the above drawings, the box-shaped frame 1 of the safety lock is fitted with fastening components by which the box is secured to the mobile wing 2 of the door.

This box is housing the motor 3, which usually is a low voltage d.c. motor provided with a driving gear 4 meshing with a driven gear 5 having a diameter apt to ensure a suitable reduction ratio of the rotary movement of the driven gear 5. A worm screw 6 is rigidly mounted on the driven gear 5, the free end of the worm 6 is resting on the support 7 mounted on the wall of the box-shaped frame 1.

A threaded slider 8, externally provided with one or more lock studs 9 is keyed onto the worm screw. The lock studs 9 are designed to enter the holes 10 in the lock plate 11 which is in some way secured to the fixed door wing 12 or to the wall around the door.

The lower end of the slider is rigidly connected to a rack 13 meshing with a gear wheel 14 which can be operated from outside the door by means of a key 15 and its cylinder 17 by acting against a loaded coil spring located inside the gear wheel 14 or frown inside by means of the knob 16. The key 15 or knob 16 are used in emergency cases as will be explained below.

The lower end 18 of the cylinder or sprocket latch 17 lodging the key 15 is cone shaped for the reasons explained hereinafter.

A boring 19 is drilled in the lower face of the rack 13 to lodge the pin tooth 20 located on the horizontal flange of an L-shaped ratchet 21 hinged onto the pin 22. This ratchet 21 and its pin tooth or pin 20 are moved downwards by the magnètic action of a coil 23, whereas they are moved upwards by means of the spring incorporated in the coil.

In emergency cases, the upwards flange of the ratchet 21 is pushed inwards by the cone-shaped surface 18 of the cylinder 17 which moves inwards when it is pushed by the key used for emergency opening. In case of emergency, this will cause the pin 20 to come out of the boring 19 thus releasing the rack 13 which may thus move freely together with the movements of the lock studs 9 in case of power failure or failure of the electric control system.

Furthermore numerous sensors detect the position of the ratchet 21 and rack 13. The first sensor 24 identifies the closed position and complete extraction of the studs 9, whereas a second sensor 25 detects opening and complete retraction of the lock studs of the door. These two sensors 24 and 25 will turn off the motor after the lock studs 9 have completed their draw-out and draw-in travel.

Sensor 26 detects lowering of the ratchet 21 and release of the rack 13. If the ratchet 21 is lowered by an opening pulse of the remote control 34 (push button A), the sensor 26 will enable the opening drive of the motor 3. Conversely, the sensor 26 will trigger an alarm system if the ratchet 21 is lowered by the cylinder 17 (when fitting the key in the lock from outside or if ill-intentioned persons should try to hamper with the lock).

An additional sensor 27 may be located between the walls facing the door lock and the plate 11 housing the studs 9. This sensor 27 may trigger an alarm should the door be tampered with or broken open.

Levers or transmission gears 28 may be connected to the slider 8 actuating other known latching systems such as sliding bars mounted at floor level or on the doorposts.

It would be preferable to provide the safety lock here described and operating as an assembly with a normal automatic latch 29 and stud 30, return 31 and internal manual push-button 32. At the end of the rack travel 13, when the door is opened, an electromagnet 33 will be actuated causing opening of the automatic latch 29 and of its stud 30. If the studs 9 of the door lock are already open, it will suffice to unbolt the automatic latch 29 by means of the remote control 34 (push-button A) or by using the manual control push-button 32 from indoors or else by fitting the key 15 in the lock in case of emergency.

When the studs 9 are completely retracted to open the door, the key 15 may be slightly further turned in the lock so that the rack 13 during opening, will be able mechanically to activate the automatic latch 29 by means of the lever 37 and pawl 38 and thus completely open the door.

Figure 6:
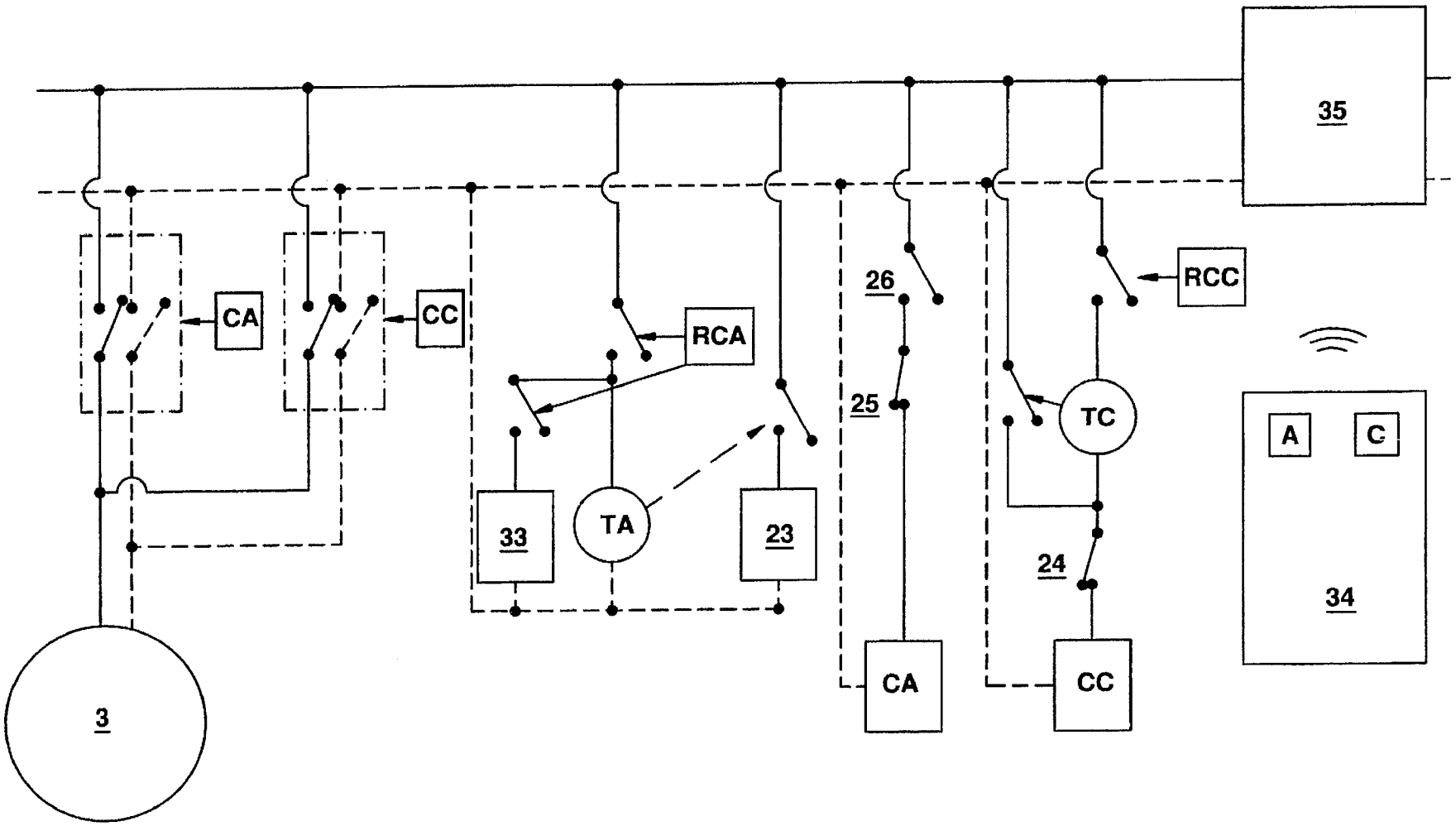
FIG. 6 shows an elementary diagram illustrating the operation of the safety lock subject matter of this invention.

Operation of this door lock will be ensured by a remote control 34 provided with only two push-buttons, i.e. push-button A to open and push-button C to close the door as shown in FIG. 6.

The wiring diagram of the safety-lock subject matter of this invention is illustrated in FIG. 6 featuring, in addition to the components already shown in the previous figures, the following elements:

Low voltage power supply by buffer battery 35

Opening Control CA

Closing Control CC

Radio Controlled Receiver for opening RCA

Radio Controlled Receiver for closing RCC

Timer for opening TA

Timer for closing TC.

The sensor 26 can also be used to actuate the alarm system (if any) which may also be triggered by the sensor 27 if the door is tampered with.

Based upon the foregoing, the door lock is functioning as follows:

Normal Electric Opening Circuit

When pressing the opening push button A of the remote control 34 from inside or outside the room closed by a door fitted with the door lock in question, the magnet 23 is energized moving the ratchet 21 and extracting the lock pin 20 from the rack 13.

The downwards movement of the ratchet 21 energizes the sensor 26. The opening timer TA will keep the ratchet 21 released for a short time after the motor has been turned ON to prevent the ratchet 21 from re-entering the boring 19 in the rack 13.

The motor is driven in the direction set by the remote control 34 and provides for retraction of the mobile studs 9 closing the lock.

Pickup of the electromagnet 23 ceases automatically so that the ratchet 21 is pushed upwards by the magnet spring 23 while the pin 20 slides along the lower surface of the rack 13 during its traverse. When the rack 13 has completed its traverse, the electromagnet 33 is energized causing opening of the automatic latch 29. The lock is now open and the sensor 25 turns the motor 3 OFF.

Normal Electric Closing Circuit

When pressing the closing push button C of the remote control 34 from inside or outside the room, the polarity of the current powering the motor 3 is reversed from CA to CC.

The timer TC has to keep the motor power circuit closed during all closing stages until the circuit is disconnected by the sensor 24. At the end of the traverse, the tooth 20 of the ratchet 21 enters the boring 19 in the rack 13 thus re-establishing the mechanical interlock. At the same time, the automatic latch 29 is automatically reset in its closing position.

Normal Electric Closing and Opening Control with Alarm System

In this case, the alarm may be connected or disconned by the sensor 26. The alarm is disconnected when the ratchet 21 is lowered to release the rack, whereas it is automatically reset when the ratchet 21 is brought in rack interlock position. The alarm is triggered whenever lowering of the ratchet 21 is not activated by the opening push button. A of the remote control 34.

Manual Operation of the Door Lock

Manual control is required in case of power failure or when the buffer battery drops below a given minimum charge level.

In such case the remote control (push-button A) is used to disconnect the alarm system so that a key 15 can be fitted into the cylinder 17.

If the key is fitted into the lock before the push-button A of the remote control 34 has been disconnected, the alarm system will be triggered thus indicating that the lock is being tampered with by ill-intentioned persons.

By fitting the key into the lock, the cylinder 17 moves inwards pressing its conical surface 18 against the upwards flange of the ratchet 21 which will rotate and release the rack 13 by pulling the pin 20 out of its boring 19. While the cylinder 17 moves inwards, it meshes with the gear wheel 14 which controls opening and closing of the rack 13.

When the mobile studs 9 closing the door are completely extracted, the key 15 is turned some more so that the rack 13 will be able mechanically to activate the automatic latch 29 by means of the lever 37 and the pawl 38 to ensure complete opening of the door.

Figure 5:
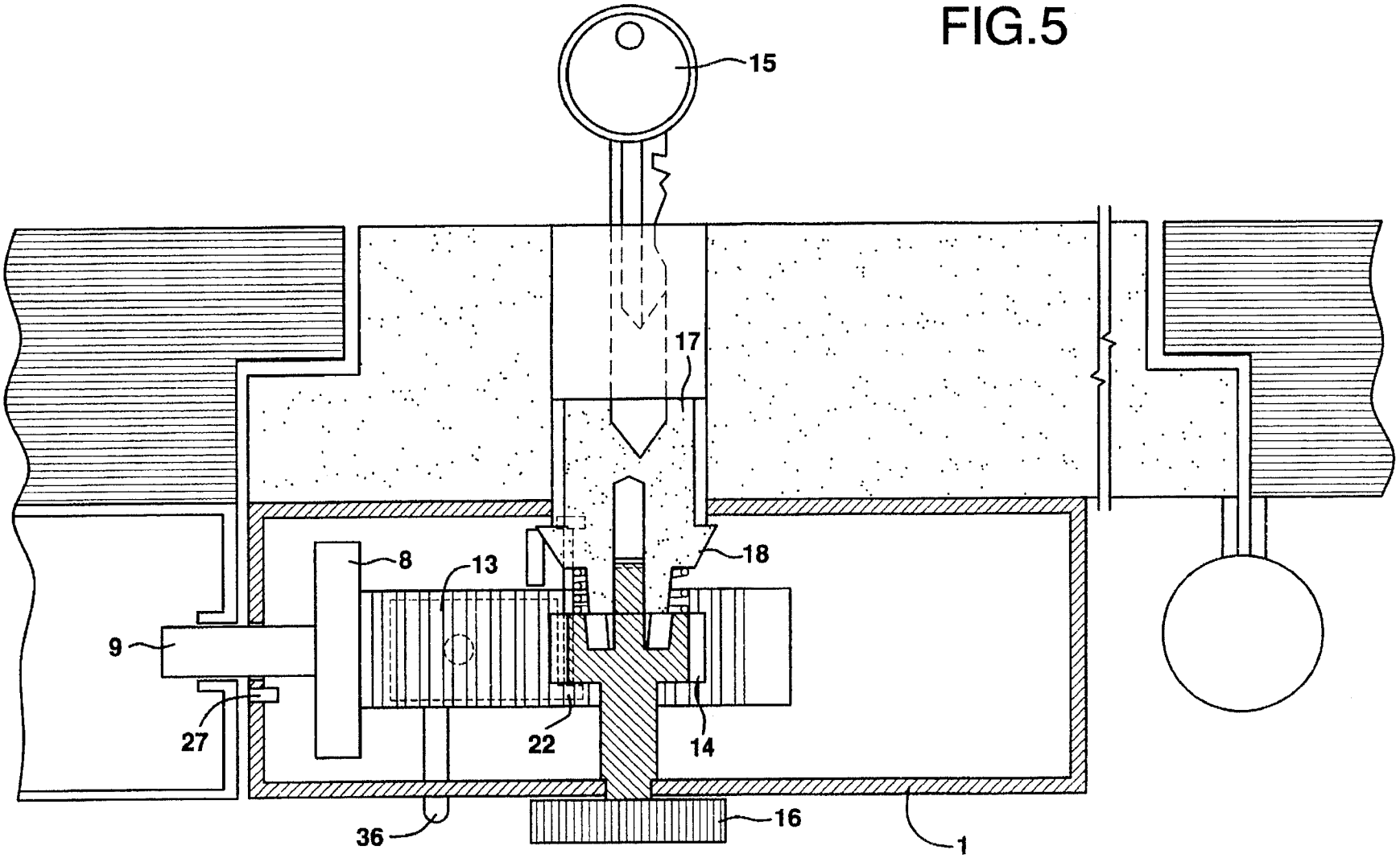
FIG. 5 shows the safety lock section according to the 5—5 axis of FIG. 1.

The door may also be opened manually from inside the room by adopting a key-based system as described above or else by means of a knob 16, after the rack 13 has been manually released, for example by a pin tooth 36 connected to the ratchet 21 as shown in FIG.5.

Manual closing of the door is achieved by turning the key or knob in the direction opposite to the sense used for opening. The spring of the magnetic coil 23 will reset the lock of the rack 13.

At this point it will be necessary to actuate the push-button C of the remote control 34 to reset the alarm system.

Operation of the Automatic Latch when the Safety Lock is Inactive in Open Position The automatic latch 29 may be opened from outside by turning the key 15 in the proper direction or from inside by pressing the push-button 32 as is normally done with known automatic latches.

It follows that the safety lock according to this invention is extremely easy to use and safe against tampering.

We claim:

1. Electronic safety-lock mounted in a box-shaped frame (1) secured to a mobile wing (2) of a door and provided with one or more lock studs (9) entering related borings (10) drilled in a lock plate (11) fastened onto an edge of a fixed door wing (12) or to a contour wall characterized in that it is comprised of:

a motor (3) operating on low voltage d.c. and rotating in both directions a driving gear (4) keyed onto a motor shaft a driven gear (5) meshing with the driving gear (4) at a speed reduction ratio;

a worm screw (6) axially mounted on the driven gear (5) and revolving with the latter;

a threaded slider (8) keyed onto the worm screw (6);

one or more closing studs (9) rigidly connected to the slider (8) and cooperating with the boring(s) (10) in the lock plate (11);

a rack (13) rigidly connected to the threaded slider (8) and provided with a lower lock hole (19);

a gear wheel (14) meshing with the above mentioned rack (13);

a cylinder or sprocket latch (17) which can be axially moved inwards against the action of a spring loaded coil, to engage the gear wheel (14) with the aid of a key (15) fitted into the cylinder from outside, a surface of the cylinder or sprocket latch (17) being cone-shaped tapered (18) so that this cylinder or sprocket latch can be hand operated in emergency cases;

a knob (16) coupled to the gear wheel (14) to open the door from inside in case of emergency, after having released the rack (13) by means of a pin tooth (36) located inside the door;

an L-shaped ratchet (21) located below the rack (13) and oscillating on a pin (22) transverse to the frame, so that a vertical flange of the ratchet (21) will touch the cone-shaped portion (18) of the cylinder (17) for emergency opening;

a blocking pin tooth (20) located on an upper face of a horizontal flange of the ratchet (21) entering the hole (19) in the rack (13) to ensure its interlock;

an electromagnet (23) activating the ratchet (21) to release the rack (13), provided with a return spring;

sensors (24, 25, 26) to detect the release position of the ratchet (21) as well as the open and closed positions of the rack (13);

a remote control (34) with opening push-button (A) and closing push-button (C), controlling an electric operating circuit.

2. Safety-lock as described in claim 1, characterized in that it may be provided with an automatic latch (29) and push-button (32) controlled from indoors.

3. Safety-lock as described in claim 2, characterized in that the automatic latch (29) is operated by the push-button (32) to open the door or by an electromagnet (33) energized by the rack (13) at the end of its opening path.

4. Safety-lock as described in claim 2, characterized by the fact that in emergency cases, the automatic latch (29) is opened, with the aid of a lever (37) and pawl (38), by the rack (13) which is moved beyond its normal position when the lock is opened with the key (15).

5. Safety-lock as described in claim 1, characterized in that the knob (16) used to open the door from inside a room in case of emergency, may be replaced by a key (15) operated sprocket latch (17) similar to the outside sprocket latch.

6. Safety-lock as described in claim 1, characterized by the fact that the electric circuit also includes:

a low voltage d.c. power supply unit (35) with buffer battery;

an opening control (CA) actuated by the remote control (34) by means of a receiver (RCA);

a closing control (CC) actuated by the remote control (34) by means of a receiver (RCC);

an opening timer (TA)

a closing timer (TC)

and an alarm system may be installed provided with a power switch to be activated when the safety-lock is closed.

7. Safety-lock as described in claim 1, characterized in that a sensor (27) may be placed between the fixed and mobile door-wings to trigger an alarm when the safety-lock is tampered with.

8. Safety-lock as described in claim 1, characterized by the fact that when pressing the opening push-button (A) of the remote control (34) from inside and outside the door, the rack (13) is released by the electromagnet (23) controlling the ratchet (21) thus starting the motor (3) which will draw in the stud(s).

9. Safety-lock as described in claim 1, characterized by the fact that when pressing the closing push-button (C) of the remote control (34) from inside and outside the door, the motor (3) is reversed so that the stud(s) (9) are drawn out causing the rack (13) to be blocked by the pin tooth (20) of the ratchet (21).

10. Safety-lock as described in claim 1, characterized in that disconnection of an alarm system, will enable to open or close the door with the key (15) and its cylinder (17) or to open and close the door from inside a room by means of the knob (16).

* * * * *